United States Patent [19]

Vennard

[11] 4,157,007

[45] Jun. 5, 1979

[54] ASYMMETRIC DIGITAL WATCH MODULE

[75] Inventor: John Vennard, Los Gatos, Calif.

[73] Assignee: National Semiconductor Corporation, Santa Clara, Calif.

[21] Appl. No.: 753,364

[22] Filed: Dec. 22, 1976

[51] Int. Cl.[2] ..... G04C 3/00; G04C 19/00

[52] U.S. Cl. ..... 58/23 R; 58/50 R

[58] Field of Search ..... 58/23 R, 50 R, 85.5, 58/88 R, 90 R

[56] References Cited

U.S. PATENT DOCUMENTS

| | | | |
|---|---|---|---|
| 3,838,568 | 10/1974 | Zurcher et al. | 58/23 R X |
| 3,911,666 | 10/1975 | Haber | 58/23 R X |
| 3,973,099 | 8/1976 | Morris, Sr. | 58/85.5 X |
| 3,983,689 | 10/1976 | Burke et al. | 58/23 R X |
| 3,986,335 | 10/1976 | Harper | 58/50 R |
| 4,001,553 | 1/1977 | Troutman et al. | 58/23 R X |
| 4,009,564 | 3/1977 | Zurcher | 58/23 R |
| 4,051,662 | 10/1977 | O'Connor et al. | 58/50 R X |
| 4,060,971 | 12/1977 | O'Connor et al. | 58/23 R X |
| 4,075,825 | 2/1978 | Murakami et al. | 58/23 R |
| 4,083,177 | 4/1978 | Nishimura et al. | 58/23 R |
| 4,086,754 | 5/1978 | Yonekawa et al. | 58/50 R |

*Primary Examiner*—Stanley J. Witkowski
*Attorney, Agent, or Firm*—Brown & Martin

[57] ABSTRACT

An electronic watch module includes a circuit board having all the electronic watch components including a plurality of LED's and a CMOS integrated circuit device mounted on one side thereof defined as the face of the board. The board is of a generally flat circular configuration and having generally rectangular cutouts at the upper side thereof for mounting a crystal oscillator and a pair of arcuate slots or cutouts along the edge thereof for mounting a pair of elastomeric switch contact members. A cover for the board includes a transparent portion defining a transparent portion sealingly enclosing the LED's and an opaque portion defining an opaque compartment for sealingly enclosing the CMOS integrated circuit device. The cover is hermetically sealed to the board for sealing these components. The overall layout of the circuit on the board is related to guide flats to facilitate automatic testing.

The method disclosed includes the mounting of the electronic components of the watch including a plurality of LED's and a CMOS integrated circuit on the face of a selected printed circuit board by first screening an epoxy on selected areas of the surface of the circuit board and mounting the electronic components on the selected areas, curing the epoxy in a nitrogen purged oven, and thereafter hermetically sealing the electronic components of the watch module by means of a cover including a transparent portion sealingly enclosing the LED's and an opaque portion sealingly enclosing the CMOS integrated circuit, the cover being mounted by the step of screening epoxy on the underside thereof placing the cover on the printed circuit board clipping the board and cover together and placing in an oven purged by nitrogen and heating for a period of time sufficient to cure the epoxy.

22 Claims, 18 Drawing Figures

BOND LED'S & CMOS ON CIRCUIT BOARD.
CURE BOND.

MOUNT SPRING CONTACT & ELASTOMERIC CONTACT STRIPS.

BOND COVER TO CIRCUIT BOARD.
CURE BOND.

CONNECT WIRE LEADS TO COMPONENTS.
TEST CIRCUIT.

APPLY FACE MASK TO COVER.
FINAL TEST CIRCUIT.

APPLY BACK INSULATION & INSERT BATTERY SPRING.

ASYMMETRIC DIGITAL WATCH MODULE

BACKGROUND OF THE INVENTION

The present invention relates to electronic digital watches and pertains particularly to electronic watch modules and method of making and assembly such modules.

The design and construction of electronic digital watches involves a number of considerations. Among these are function, reliability, ease of manufacture and appearance.

Many of the factors affecting reliability of a watch include the shock resistance of the components, the resistance of the components to corosion and other such factors. Corosion resistance of the components are enhanced by sealing of the components.

Factors which affect the shock resistance of the components include the mounting thereof, the inertial of the parts, and the inertia and mounting of adjacent components.

Factors which affect the ease of manufacturing of such watch modules include the number and ease of component interconnections and the ease in testing and adjusting the finished component.

Factors which affect the appearance and styling of such watches include the bulk and shape thereof as well as the thickness and shape of the module. Other factors include the position and angles of switches and other such items.

Accordingly it is desirable that a watch module be devised wheich is reliable, easy to manufacture and easy to style for appearance.

SUMMARY AND OBJECTS OF THE INVENTION

It is therefore the primary object of the present invention to overcome the above problems of the prior art.

Another object of the invention is to provide an improved electronic watch module.

A further object of the invention is to provide an improved method of fabricating an electronic watch module.

Still another object of the invention is to provide an improved electronic watch module that is simple and easy to manufacture and test.

In accordance with the primary aspect of the invention an electronic watch module includes a printed circuit board having all watch components mounted on one side thereof with a cover hermetically sealing the components with the display covered by a transparent cover and the remainder of the components covered by an opaque cover. The module is constructed with an indexing flat for indexed location within a holder so that contacts selectively located on the module are appropriately located to facilitate automatic machine testing.

BRIEF DESCRIPTION OF THE DRAWING

The above and other objects and advantages of the present invention will become apparent from the following description when read in conjunction with the accompanying drawings wherein.

DETAILED DESCRIPTION OF THE PREFERRED EMBODIMENT

Figure 1:
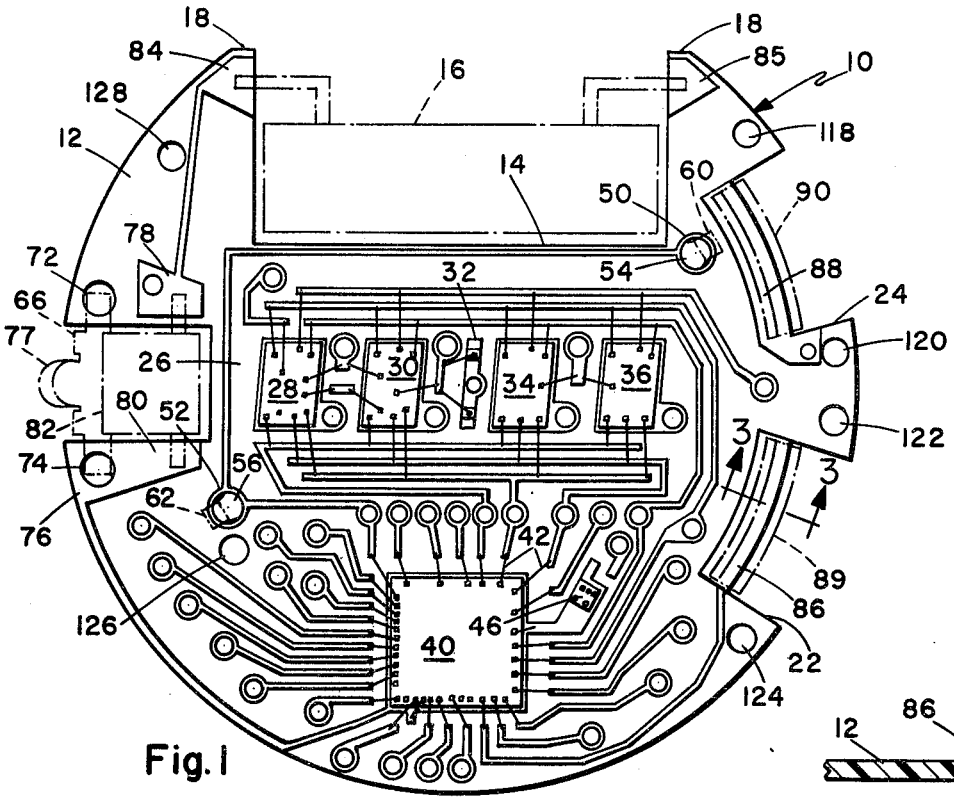
FIG. 1 is a top plan view of an electronic watch circuit board in accordance with the present invention.
Figure 3:
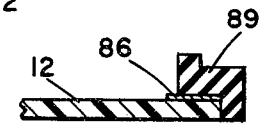
FIG. 3 is an enlarged sectional view taken on line 3—3 of FIG. 1.
Figure 2:
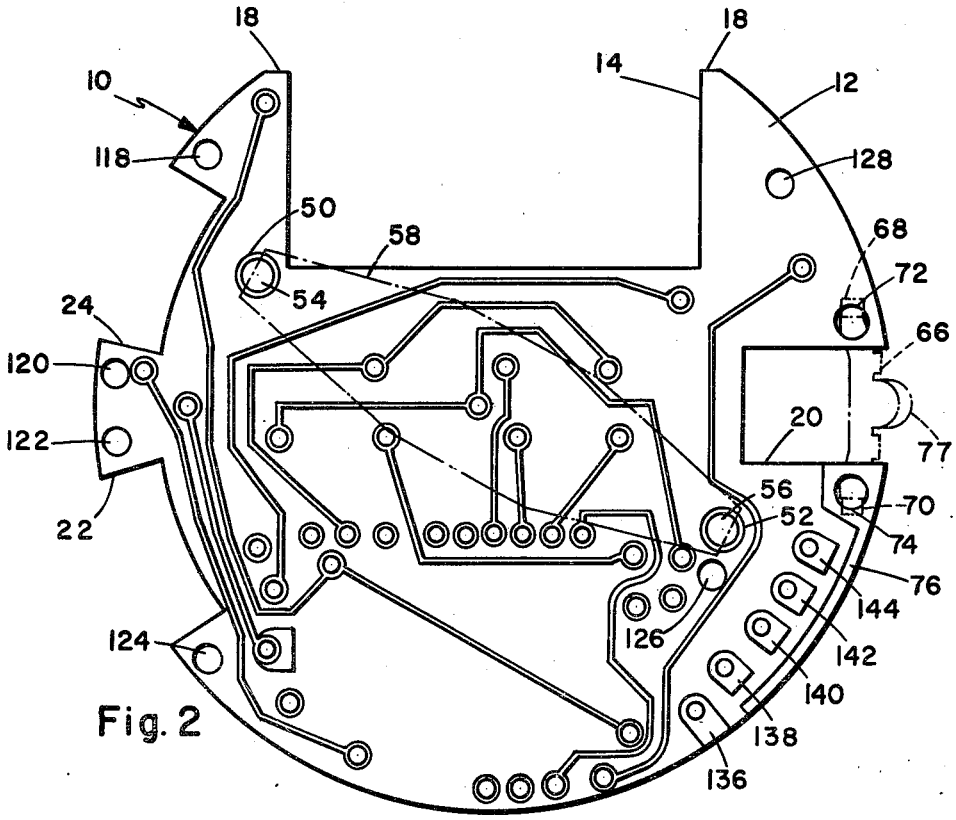
FIG. 2 is a bottom plan view of the circuit board of FIG. 1.
Figure 4:
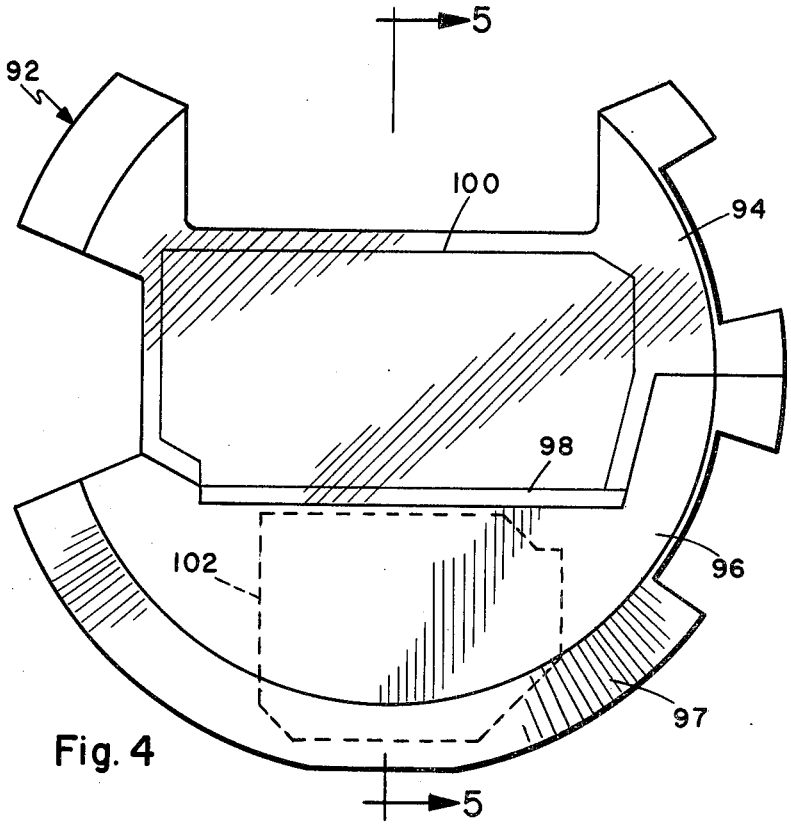
FIG. 4 is a top plan view of a cover for the board of FIG. 1.

Turning now to FIGS. 1–3 of the drawings, there is illustrated a printed circuit board designated generally by the numeral 10 for a digital electronic watch. The printed circuit board 10 is of a generally flat circular configuration with a number of cutouts around the outer edge thereof. The circuit board is preferably fabricated of the usual insulative material in the usual manner. The circuit however is of a predetermined layout selected to provide an optimum arrangement of components in accordance with the objects and principals of the present invention. The printed circuit includes a supporting board or substrate 12 that is constructed of any suitable material having the desired dimensional stability, rigidity and insulation characteristics. For example, certain ceramic materials have these desired characteristics. A first cutout 14 of a generally rectangular configuration provides means for receiving and mounting a crystal oscillator 16 shown in phantom. This cutout is also associated with a pair of flats 18 on the periphery of the disc substrate 12 which forms an alignment guide structure for a use which will be explained later.

A second generally rectangular cutout 20 is provided for receiving and mounting a trimmer capacitor if needed, and a contact spring member for the case or power supply.

A pair of arcuate shaped cutouts 22 and 24 are provided substantially diametrically across from cutout 20 for receiving special elastomeric switch contacts to be described which will provide flexibility in the design and location of actuator buttons or pins for display and other control.

The above described board is selected and formed with the described cutouts and the basic printed circuit board laid out and formed with the appropriately located pads and conductor strips as illustrated in order to facilitate automatic testing. The board is arranged and laid out to mount all components of the circuit on the face side thereof as shown in FIG. 1. Selected areas such as a generally rectangular area 26 extending across the center thereof are left open for the mounting of electronic watch components. The area 26 is specifically designed to mount display means which may be in the form of either a plurality of light emitting diodes (LED) or a plurality of liquid crystal diodes (LCD) or other suitable display means. The illustrated embodiment utilizes a plurality of LED's having suitable segments to achieve the desired display.

A plurality of LED's 28 through 36 are mounted in the space 26 and connected by suitable bonding such as by means of aluminum leads to the conductor frame or tapes as illustrated.

A second area of a generally square configuration located on the lower face of the board 12 is left for the mounting of a suitable integrated circuit such as a CMOS integrated circuit, including the major logic control systems of the electronic watch circuit. This area may be a contact pad such as ground for the circuit as illustrated. A CMOS integrated circuit chip 40 is mounted in the space and suitably connected electrically to the circuit board by suitable leads bonded between the contacts of the IC chip and the pads on the board. This chip includes all the electronic circuitry necessary to compute time and to drive a display with decoded time keeping signals.

The leads, such as leads 42 for example, are preferably of aluminum wire ultrasonically bonded between the terminals on the IC chip and the pads on the circuit board. Other leads and techniques of bonding may be utilized if desired.

A third small area such as a pad is provided for the mounting of a capacitor resister chip 46. This chip 46 is similarly connected into the circuit as previously described.

Figure 12:
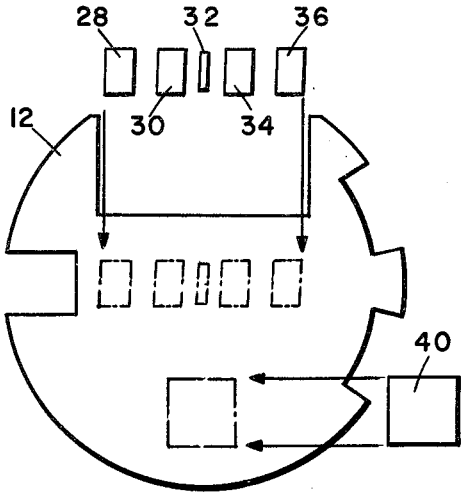
FIGS. 12–17 illustrate the steps of the method of assembling the module.
Figure 13:
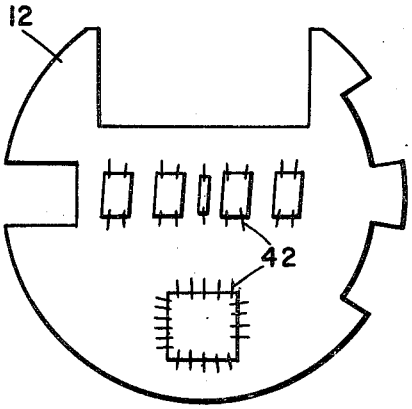

The mounting of the circuit components such as the LED's, the CMOS chip 40 and the resistor chip 46 are carried out by first selectively screening an epoxy onto the selected mounting areas, placing the respective components in the selected areas as shown in FIG. 12, and baking the entire board in a nitrogen purged oven (60 cubic feet per minute) at a 120° C. for approximately one hour. This cures the epoxy bonding of the components to the board. The LED's and IC chips are then lead bonded in a suitable manner to the leads on the board using ultrasonic bonding and one mil aluminum wire, as shown in FIG. 13.

As will be appreciated, all components are mounted solely on one side, (the face) of the board. Hence, the board and resulting module can be termed asymmetric. These components are mounted on the opposite side of the board from the location of the battery as will be seen.

Figure 10:
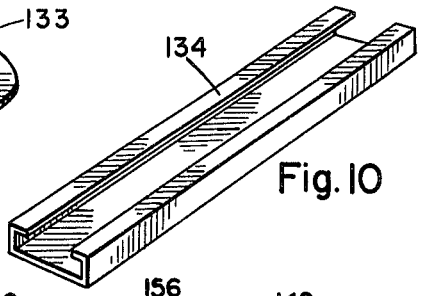
FIG. 10 is a perspective view of a test holder for the module.
Figure 18:
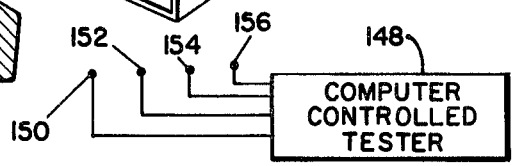
FIG. 18 is a schematic illustration of a testing device for the module.

The circuit boards is now ready for in line testing. This testing is carried out preferably by loading a plurality of the modules in a testing tube 134 as shown in FIG. 10 which consists of a substantially rectangular open sided tube or trough having a width such that the board fits in with the crystal cutout and flats 18 in engagement with one wall thereof for precisely orienting the board for automatic testing. The testing is carried out by suitable testing equipment as schematically illustrated in FIG. 18 which mounts the tubes and includes a plurality of spring biased probes such as 150 through 156 positioned for engaging the pads on the underside of the board 12 for connecting the module circuit into a computer controlled tester 148. The pads and probes are suitably located to provide automatic connection of the various circuits or components of the circuits with the testing equipment when the boards are properly positioned in the tubes. Suitable testing equipment is available in the form of a computer control tester 148 from Teradyne Corporation as Model No. Teradyne 193.

As previously described, the circuit board layout is such to provide optimum arrangement of the components thereon for appropriate mounting and separation thereof. The design also provides optimum flexibility in design of a watch case for housing the electronic components of the watch. The circuit pads are appropriately located on the printed circuit board to permit automatic testing thereof as above described.

Figure 11:
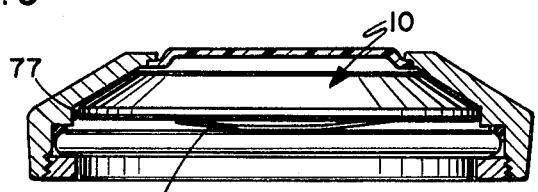
FIG. 11 shows the module installed in a typical watch case, which is sectioned to show the battery and associated structure.

Power is supplied to the electronic circuit through terminals 50 and 52 which are printed through holes for access at the back of the board as shown in FIG. 2. These battery terminals are formed around bores 54 and 56 which receive the ends of a bow type leaf spring 58 having tab ends 60 and 62 which extend through the bores 54 and 56 for making contact therewith. The bow spring 58 provides contact with one terminal of a single battery as shown in FIG. 11. The battery serves also as the back of the watch and is connected at its other terminal, such as the case or can thereof directly to the watch houseing.

The positive terminal of the battery is connected into the circuit by means of the watch case and a spring contact member 66, which includes a pair of spaced tabs 68 and 70 which extend into holes 72 and 74, while hole 74 providing contact with a pad and conducting strip 76 to the circuit. The spring contact member 66 includes an outer extending contact member or portion 77 which engages the watch case.

Connecting pads are also provided at 78 and 80 to either side of the cutout 20 for the connection of a trimmer capacitor 82, illustrated in phantom, if needed.

The quartz crystal 16 is connected into the circuit at pads 84 and 85 at the sides of cutout 14.

Switch contact pads or strips 86 and 88 are provided in the respective cutouts 22 and 24 for providing for the mounting of switch contacts such as for display command and for time setting of the watch circuit. A pair of elongated conductive rubber or elastomeric contact members 89 and 90, having a generally Z-shaped cross sectional configuration, are mounted within the cutouts 22 and 24 and on the contact strips 86 and 88, as shown in FIG. 3. These are held in place by a cover described below.

These contact pads each extend for a substantial distance or angle along the edge of the board. The area covered by these contact pads or strips permit a wide choice of placement of switch plungers within the case. The plungers can be placed anywhere along the edge of the case adjacent the strips 89 and 90. The plungers can be placed at a substantially any angle so long as they can be pressed into engagement with the large substantially flat area of the contact members.

After the electronic components including the LED's and the CMOS integrated circit are mounted on the face of the circuit board and the necessary electronic connections are made, the major circuit components including the LED and the CMOS integrated circuit are hermetically sealed by means of a cover illustrated in FIGS. 4–7.

Figure 5:
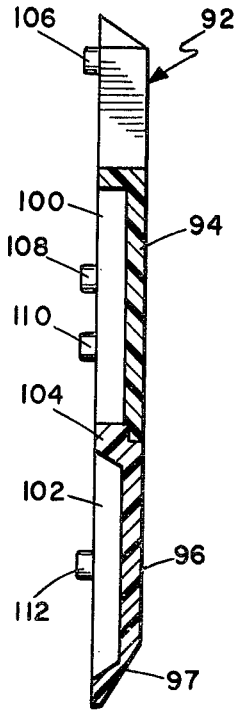
FIG. 5 is a sectional view taken on line 5—5 of FIG. 4.
Figure 6:
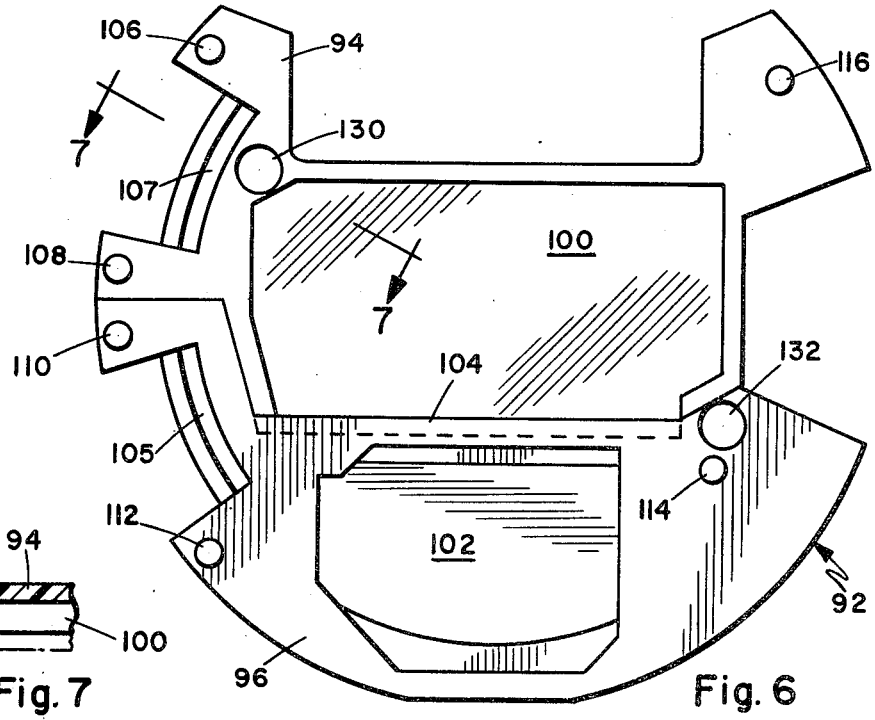
FIG. 6 is a bottom plan view of the cover of FIG. 4.
Figure 7:
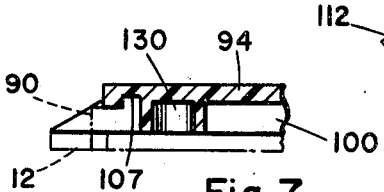
FIG. 7 is a sectional view taken on line 7—7 of FIG. 6.
Figure 8:
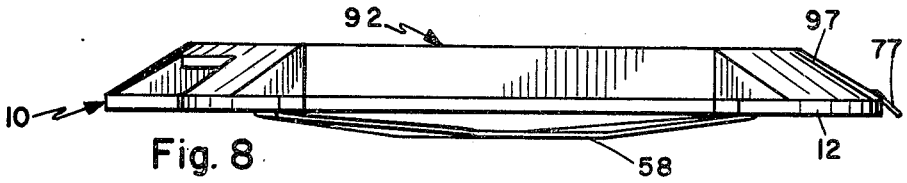
FIG. 8 is a side elevation view of the assembled circuit board and cover, with the battery spring attached.

The cover, generally designated by the numeral 92 comprises a clear plastic LED cover portion 94 and an opaque CMOS covering portion 96. The overall angular shape of the cover is substantially the same as that of the printed circuit board containing similar cutouts or the like. The cover is tapered from the bottom outer edge inward to the top as seen in FIGS. 5 and 8. This taper improves the adaptability to styling of the module. The clear plastic of LED cover portion may be constructed of a material such as polycarbonate. This clear portion has a generally rectangular shape. The opaque or integrated circuit cover portion for the CMOS cover is also constructed of a suitable plastic such as that known as Lexan, or equivalent, preferably black in color. These two members if constructed separately may be bonded together by suitable means along a joint 98 to form a unitary cover.

The cover is designed to set directly on the face of the printed circuit board of FIG. 1 and provide a first or clear compartment 100 and a second or opaque compartment 102. These compartments are separated by a wall 104 so that both compartments will be isolated thus isolating the LED's from the CMOS integrated circuit. This cover includes a plurality of pins 106 through 116 which register with a plurality of cooperating holes 118 throuh 128 on the PC board for alignment of the cover with respect to the board. A pair of sockets 130 and 132 register with holes 54 and 56 to permit the extension of the battery connecting spring therethrough.

Figure 14:
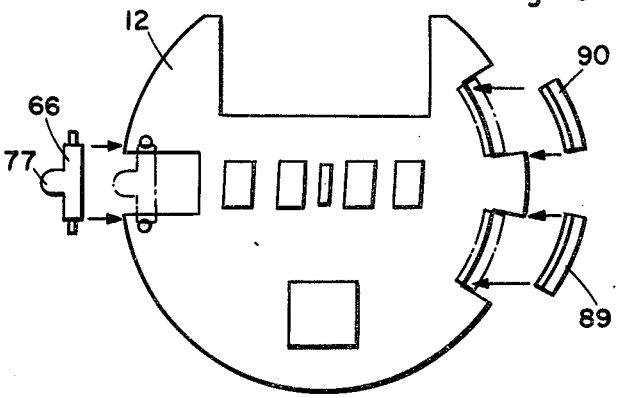

Just prior to the step of mounting the cover on the PC board, the contact members 89 and 90 are placed in the cutouts 22 and 24 on the printed circuit board in contact with the contactor or conductor strips 86 and 88 and spring contact 66 is placed in position as shown in FIG. 14. The cover includes channels 105 and 107 which engage the flanges of the contact pads or members 89 and 90 and retain them in place on the PC board. These arcuate pads permit a wide angle of placement of the switches on the outer periphery of the watch case.

Figure 15:
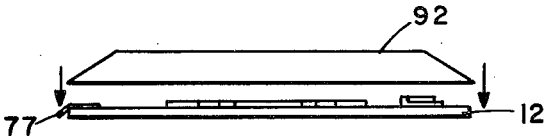

Attachment or mounting of the cover to the PC board is carried out by screening an epoxy onto the underside of the cover, placing the cover on the PC board as in FIG. 15 and clipping it in place, and thereafter placing the assembly in an oven that is nitrogen purged and heated to cure the epoxy.

Figure 9:
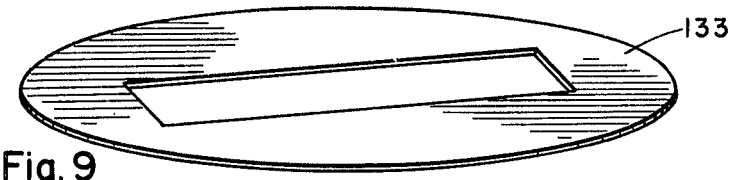
FIG. 9 is a perspective view of the face mask.
Figure 16:
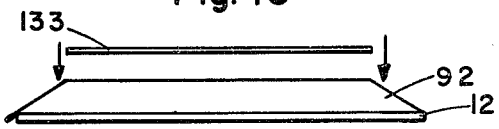

The spring contact 66 has several functions, such as connecting the battery to the module via the case, locating the module accurately within the case by engaging in a location holes 72, 74 to prevent angular misalignment, ad it forces the module to the switch side of the case thus eliminating one critical tolerance for the case manufacture. It also prevents the module from falling out of the watch when the battery case is removed. The next stage of the manufacture is to place an adhesive back black Mylar face mask on the display side of the module, as in FIG. 16. This face mask 133 is shaped as illustrated in FIG. 9 with a rectangular cutout which fits over the display (LEDS).

The watch module is now ready for the final test. The test is carried out by placing the module in a slotted rectangular cross section testing tube 134 as illustrated in FIG. 10. The module as previously described includes a flat side (cutout 14 and flats 18) which locates the module with respect to the tube 134 and prevents rotation or misalignment thereof. This location flat on the module maintains the module in the proper orientation in the testing tube 134 so that it may be automatically tested in a test machine. The tube 134 can be preloaded with watch modules and fed into a handle similar to a dual in line tester which would then interface with an automatic test system. Since the display connection points are all available, it will be possible via computer control to fully test the watch at final test and to automatically bin the devices as good or rejects.

In addition, the design of the module allows computer control of the frequency adjustment. For example, a CMOS unit such as that manufactured by the Assignee here under Catalog No. MM 48115 can be used which has digital control of the frequency and requires that the frequency of the crystal oscillator is compensated by adding the count-down chain ratio rather than moving the frequency of oscillation of the crystal. This is implemented by first measuring the frequency of the crystal and then calculating which combination of fixed counts shall be added or subtracted to achieve an accurate watch. In this module design, this can be done at final test by the computer. In accordance with this procedure, the frequency is first monitored at the 4Hz test point and then decoded within the computer or microprocessor memory as to which of the pads 136 through 144 must be shorted or connected to the plus terminal at 76. This connection is carried out by means of 5 solenoid controlled inkers which contain a material such as conductive epoxy. By acuating selected ones of these inkers, in the final test sequence the frequency can be trimmed to tolerance. The ink would have to be dried, which could be done by an infrared bake lamp focused on the PC board at or shortly beyond this point.

Figure 17:
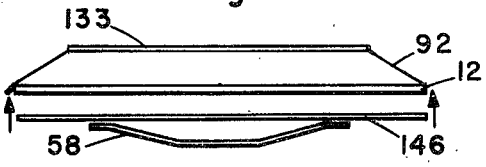

The penultimate operation is the placement of a mylar insulating disc 146 on the back of the module as shown in FIG. 17. This insulating dics is provided with holes which register with battery contacts 50 and 52 to permit contact to be made by the battery spring 58. This now insulates the back of the printed circuit board and the interconnections thereon from the case and battery. The insulating disc can also be printed with a logo and/or other necessary information.

The final assembly step is to clip the battery contact spring 58 into place. This spring clips through holds 54 and 56 in the back of the printed circuit board to engage contacts 50 and 52 which connect to the circuit negative voltage points. The battery spring also shock mounts the module allowing it to float in the case between the case front and the battery.

This watch module is designed to fit within a watch case substantially as that shown in FIG. 11 which is also designed to utilize a special battery as shown. In this design the module and battery are supported independently of one another, so that the mass or inertia of the battery is not imposed on the module when subjected to shock. The construction also provides a slimmer profile than prior electronic watches.

The herein described watch construction also provides numerous other advantages over prior art constructions. From the manufacturing stand point these include ease of lead bond interconnection, ease of repair, ease of in line testing by computer controlled machine, low number of solder joints, switch contact assembly without solder, and final testing by computer controlled machine.

The reliability of the module is enhanced by the hermetic light proof enclosure of the CMOS circuit. This provides a proven advantage over the prior art technique of covering the CMOS with silicon or an epoxy coating since the lead bonds are not subjected to differential expansion when the watch is temperature cycled.

The taper of the module from the substrate area to the display area of the LED allows the case design to have a minimum thickness at the outer edge. The switch position flexibility also allows the switches to be placed to suit the case styles.

The present design also permits a wider tolerance in case sizing. The positive contact spring 66 which is located opposite the switch contact biases the module toward the switch pushers or plungers. This eliminate the close fit tolerances that would normally be required.

While the present invention has been described and illustrated by means of a specific embodiment, it is to be understood that numerous changes and modifications may be made therein without departing from the spirit and scope of the invention as defined in the appended claims.

Having described my invention, I now claim:

1. An electronic watch module having a thin profile, said module comprising:

a printed circuit board having a generally flat circular configuration defining a face and a back, electronic watch components including display means mounted on said face of said board, and a cover permanently secured to said face and defining walls spaced from and hermetically sealing said electric watch components on the face of said board, said cover having separate hermetically sealed compartments including a transparent portion covering said display means and an opaque portion covering other components on said face, the thickness of said module being defined substantially by the sum of the thickness of said board and the thickness of said cover.

2. An electronic watch module of a thin profile, said module comprising:

a printed circuit board having a thin generally flat circular configuration defining a face and a back, and having alignment guide means associated therewith.

electronic watch components including display means mounted on said face of said board, a plurality of probe pads located on the back of said board in predetermined positions with respect to said guide means and each pad connected to one of said electronic watch components and thereby adapted for automatic external testing of said electronic watch components, and a cover defining wall means spaced from and hermetically sealing said face of said board, said cover having a transparent portion covering said display means in spaced relation thereto and an opaque portion covering other electronic watch components on said face in spaced relation thereto, the thickness of said module consisting substantially of the thickness of said cover and the thickness of said printed circuit board.

3. The watch module of claim 1 including a plurality of cut out portions around the periphery of said board, one of said cut-outs defining alignment guide means for said board.

4. The watch module of claim 1 including a plurality of guide pins and cooperating guide bores for positively locating said cover on said board.

5. The watch module of claim 2, wherein said display means includes a plurality of light emitting diodes, and said electronics includes a CMOS device having means for computing time and means for driving means with decoded time keeping signals.

6. The watch module of claim 3, wherein one of said cutouts is adapted to receive an oscillator crystal, and a pair of said cutouts are adapted to receive a pair of resilient switch contact members.

7. The watch module of claim 6, wherein said switch contact members are elastomeric conductive members extending along in an arc in said cutouts.

8. The watch module of claim 7, wherein said conductive members are positioned in engagement with a pair of leads on said printed circuit board and are held in place by said cover.

9. The watch module of claim 3, wherein said cutout defining said alignment guide means is substantially rectangular in configuration for receiving and mounting a crystal oscillator, and leads on said board adjacent said cutout for electrical connection to said oscillator.

10. The watch module of claim 9, including at least one arcuate shaped cutout adjacent said rectangular cutout for mounting an elongated elastomeric switch contact member in engagement with a lead on said board for providing switch contact means for controlling said electronics components.

11. The watch module of claim 10 including a further cutout substantially diametrically across from said arcuate cutout for mounting spring contact means for providing an electrical connection between a lead on said board and a watch case in which said module is mounted, and said spring contact means biasing said module toward the opposite side of said watch case.

12. The watch module of claim 7, wherein said switch contact members are generally Z-shaped in cross-section.

13. The watch module of claim 11, wherein said further cutout is also adapted to mount a trimmer capacitor, and said board includes leads for electrical connection to said trimmer capacitor.

14. The watch module of claim 2, wherein said transparent portion is generaly rectangular in configuration and said cover tapers upward from said printed circuit board to said transparent portion.

15. The watch module of claim 11, wherein said cover is of a generally frusto-conical configuration tapering upward from said board to said transparent portion.

16. The watch module of claim 5, wherein said pads are located with respect to guide means defined on said board for loading into a slotted rectangular tube for feeding into computer controlled machines for testing.

17. The watch module of claim 16, wherein said CMOS device includes digital frequency control, and said device includes count down ratio means for compensating the frequency of said oscillator, and said frequency is trimmed during final testing by conductor means selectively connecting a selected one of a plurality of pads located on the back of said circuit board into said circuit.

18. The watch module of claim 2, wherein the back of said board includes an insulating cover covering electrical contacts thereon.

19. The watch module of claim 18 wherein said cover is an adhesive backed Mylor disc.

20. The watch module of claim 17 including a Mylor insulating disc covering the back of said module.

21. The watch module of claim 2 including a Mylor disc covering the face of said module.

22. The watch module of claim 18 including a black Mylor disc covering the face of said module.

* * * * *